US012157157B2

(12) United States Patent
Mori et al.

(10) Patent No.: US 12,157,157 B2
(45) Date of Patent: Dec. 3, 2024

(54) PRESSING MACHINE AND PRESSED PRODUCT MANUFACTURING METHOD

(71) Applicant: ASAHI-SEIKI MANUFACTURING CO., LTD., Owariasahi (JP)

(72) Inventors: Fujio Mori, Owariasahi (JP); Seiji Kobayashi, Seto (JP); Akihiro Shiino, Owariasahi (JP); Katsuyuki Inoue, Seto (JP); Ken Hibino, Seto (JP)

(73) Assignee: ASAHI-SEIKI MANUFACTURING CO., LTD., Owariasahi (JP)

( * ) Notice: Subject to any disclaimer, the term of this patent is extended or adjusted under 35 U.S.C. 154(b) by 317 days.

(21) Appl. No.: 17/617,806

(22) PCT Filed: Jan. 19, 2021

(86) PCT No.: PCT/JP2021/001660
§ 371 (c)(1),
(2) Date: Dec. 9, 2021

(87) PCT Pub. No.: WO2021/153344
PCT Pub. Date: Aug. 5, 2021

(65) Prior Publication Data

US 2022/0241835 A1 Aug. 4, 2022

(30) Foreign Application Priority Data

Jan. 31, 2020 (JP) ..... 2020-014494

(51) Int. Cl.
*B21D 22/02* (2006.01)
*B21D 22/30* (2006.01)
(Continued)

(52) U.S. Cl.
CPC ..... *B21D 22/02* (2013.01); *B21D 22/30* (2013.01); *B21D 43/003* (2013.01); *B21D 43/05* (2013.01); *B21D 45/006* (2013.01); *B21D 45/04* (2013.01)

(58) Field of Classification Search
CPC ..... B21D 43/003; B21D 22/21; B21D 22/30; B21D 43/05
See application file for complete search history.

(56) References Cited

U.S. PATENT DOCUMENTS 2,279,417 A 4/1942 Stevens
4,736,612 A * 4/1988 Russell ..... B21D 5/0209 72/448
(Continued)

FOREIGN PATENT DOCUMENTS

CN 1129639 A 8/1996
CN 105382098 A 3/2016
(Continued)

OTHER PUBLICATIONS

Feb. 10, 2023 Office Action issued in Chinese Patent Application No. 202180003445.3.
(Continued)

*Primary Examiner* — Debra M Sullivan
(74) *Attorney, Agent, or Firm* — Oliff PLC

(57) ABSTRACT

A pressing which a ram repeats an up-and-down motion for press working machine that performs a continuous operation in by a press die held by a die holding portion of a bolster and a die holding portion of the ram includes: a die positioning portion that positions the press die in a first direction being a moving direction of the ram; a position adjustment mechanism having a servomotor as a drive source and optionally changing a position where the press die is positioned by the die positioning portion; and a drive control unit driving, when position change data is given during the
(Continued)

continuous operation, the servomotor such that the position where the press die is positioned by the die positioning portion is changed to a position corresponding to the position change data when reaction force of the press working not applied to the die positioning portion during continuous operation.

22 Claims, 11 Drawing Sheets

(51) Int. Cl.

| | |
|---|---|
| ***B21D 43/00*** | (2006.01) |
| ***B21D 43/05*** | (2006.01) |
| *B21D 45/00* | (2006.01) |
| *B21D 45/04* | (2006.01) |

(56) References Cited

U.S. PATENT DOCUMENTS

| | | | |
|---|---|---|---|
| 5,706,711 | A | 1/1998 | Ito |
| 2016/0059296 | A1 | 3/2016 | Frost et al. |
| 2016/0114381 | A1 | 4/2016 | Ciocirlan et al. |
| 2019/0118242 | A1 | 4/2019 | Steiner |

FOREIGN PATENT DOCUMENTS

| | | | |
|---|---|---|---|
| CN | 105680284 | A | 6/2016 |
| CN | 106064194 | A | 11/2016 |
| DE | 27 43 642 | A1 | 3/1978 |
| EP | 2 486 993 | A1 | 8/2012 |
| GB | 789408 | A | 1/1958 |
| JP | S61-276722 | A | 12/1986 |
| JP | 2002-331318 | A | 11/2002 |
| JP | 2016-203212 | A | 12/2016 |
| JP | 2018-153823 | A | 10/2018 |

OTHER PUBLICATIONS

Feb. 16, 2021 International Search Report issued in International Patent Application No. PCT/JP2021/001660.

Dec. 8, 2020 Office Action issued in Japanese Patent Application No. 2020-014494.

Sep. 9, 2022, Search Report issued in European Patent Application No. 21748210.8.

Sep. 11, 2024, Search Report issued in European Patent Application No. 21748210.8.

* cited by examiner

PRESSING MACHINE AND PRESSED PRODUCT MANUFACTURING METHOD

TECHNICAL FIELD

The present disclosure relates to a pressing machine and a pressed product manufacturing method using the pressing machine.

BACKGROUND ART

Known pressing machines include a pressing machine for drawing, ironing, or crushing a workpiece (see, for example, Patent Literature 1).

CITATIONS LIST

Patent Literature

Patent Literature 1: JP 2016-203212 A (paragraph [0021], FIG. 1)

SUMMARY OF INVENTION

Technical Problems

Meanwhile, in a conventional pressing machine, the thickness, position, and shape of a portion to be worked of a workpiece change little by little due to thermal expansion of a press die or the like during continuous operation, and the workpiece may eventually become a reject. In order to prevent such rejects, in a case where a difference between an actual measurement value and a design value of the portion to be worked of the workpiece has become equal to or greater than a reference value, the pressing machine is temporarily stopped, holding of the press die by a die holding portion is loosened, and the position of the press die is adjusted. The conventional pressing machine requires such troublesome work, and thus has had a problem of decrease in production efficiency. The present disclosure therefore provides a pressing machine and a pressed product manufacturing method capable of improving production efficiency as compared with a conventional art.

Solutions to Problems

The pressing machine of the present disclosure made to solve the above problems provides a pressing machine that performs a continuous operation in which a ram repeats an up-and-down motion for press working on a workpiece by a press die held by a die holding portion of a bolster and a die holding portion of the ram, the pressing machine including: a die positioning portion that positions the press die in a first direction which is a moving direction of the ram; a position adjustment mechanism that has a servomotor as a drive source and optionally changes a position where the press die is positioned by the die positioning portion; and a drive control unit that drives, when position change data is given during the continuous operation, the servomotor in such a way that the position where the press die is positioned by the die positioning portion is changed to a position corresponding to the position change data when reaction force due to the press working is not applied to the die positioning portion in a state where the continuous operation is continued.

DESCRIPTION OF EMBODIMENTS

First Embodiment

Figure 1:
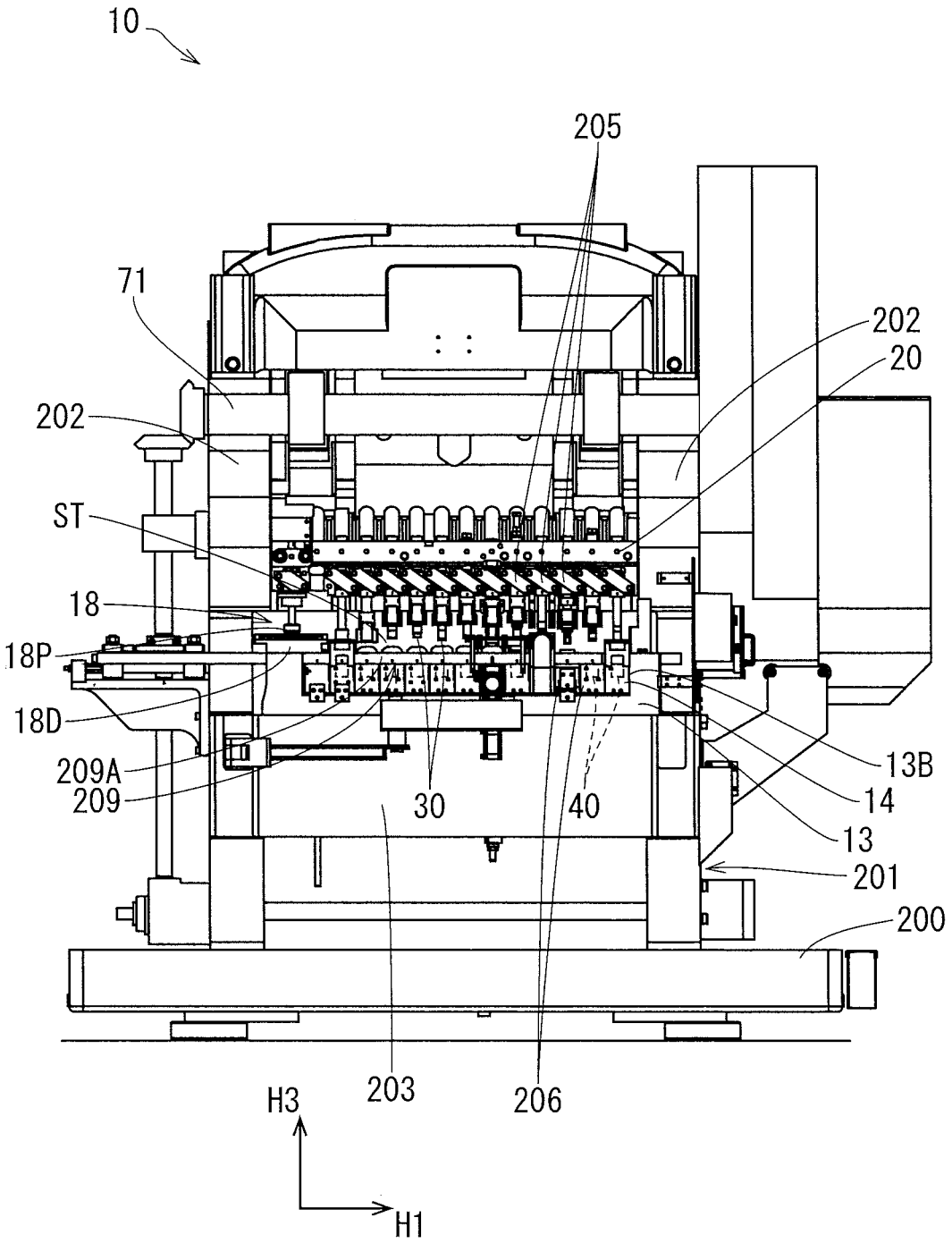
FIG. 1 is a front view of a pressing machine according to a first embodiment.

Hereinafter, a pressing machine 10 according to an embodiment of the present disclosure will be described with reference to FIGS. 1 to 7. FIG. 1 illustrates the entire pressing machine 10 of the present embodiment. Hereinafter, the lateral direction in FIG. 1 is referred to as a lateral direction H1 of the pressing machine 10, the direction perpendicular to a paper surface of FIG. 1 is referred to as a front-rear direction H2 (corresponding to the "second direction" in the claims, see FIG. 2) of the pressing machine 10, and the vertical direction in FIG. 1 is referred to as a vertical direction H3 (corresponding to the "first direction" in the claims) of the pressing machine 10. Furthermore, FIG. 1 shows a front side of the pressing machine 10, and the opposite side is referred to as a rear side. Moreover, the right side and the left side in FIG. 1 are simply referred to as the right side and the left side of the pressing machine 10 or the like.

As illustrated in FIG. 1, the pressing machine 10 has a support frame 201 standing upright from a support plate 200. The support frame 201 has a structure in which a pair of opposing walls 202 facing each other in the lateral direction H1 are connected by a bolster support beam 203 and a ram support wall (not illustrated).

The bolster support beam 203 has, for example, a quadrangular cross section, extends in the lateral direction H1, and is laid between positions close to lower ends of the pair of opposing walls 202. A slit (not illustrated) penetrating in the vertical direction H3 is formed at the center of the bolster support beam 203 in the front-rear direction H2. Then, a bolster 13 is fitted and fixed to an upper surface of the bolster support beam 203.

The ram support wall has a plate shape with its thickness direction in the front-rear direction H2, and is laid between rear edge portions of opposing surfaces of the pair of opposing walls 202, above the level of the center of the pair of opposing walls 202 in the vertical direction. Then, a ram 20 is slidably attached to a front surface of the ram support wall.

A cam shaft 71 is laid between and rotatably supported by positions close to upper ends of the pair of opposing walls 202. Then, the ram 20 receives power from the cam shaft 71, and repeats an up-and-down motion.

A press die of the pressing machine 10 of the present embodiment includes a plurality of punches 30 and a plurality of dies 40. In addition, for the purpose of holding the plurality of punches 30, a plurality of die holding portions 205 is provided at a bottom portion of the ram 20 so as to be arranged at a constant pitch in the lateral direction H1. Moreover, for the purpose of holding the plurality of dies 40, a plurality of die holding portions 206 is provided at an upper surface of the bolster 13 so as to be arranged at a constant pitch in the lateral direction H1. Then, the plurality of punches 30 and the plurality of dies 40 face each other in a plurality of pairs, the punch 30 and the die 40 of each pair constitute a working stage ST, and a workpiece 90 is pressed in each working stage ST.

The workpiece 90 is generated from sheet metal by a workpiece feeder 18 disposed further on the left side of the working stage ST at the left end. In the workpiece feeder 18, a punching die (not illustrated) is supported by a frame 18D and is disposed so as to be suspended above the die holding portions 206. In addition, the workpiece feeder 18 is provided with a punch 18P having a nesting structure in which a cylindrical second punch is fitted outside a first punch (not illustrated), and the punch 18P is attached to the ram 20. Then, in synchronization with the motion of the ram 20, the sheet metal is fed from the rear by pitch feeding, a blank material is punched out of the sheet metal by the second punch, and the blank material is drawn by the first punch to generate a cylindrical workpiece 90.

Figure 4:
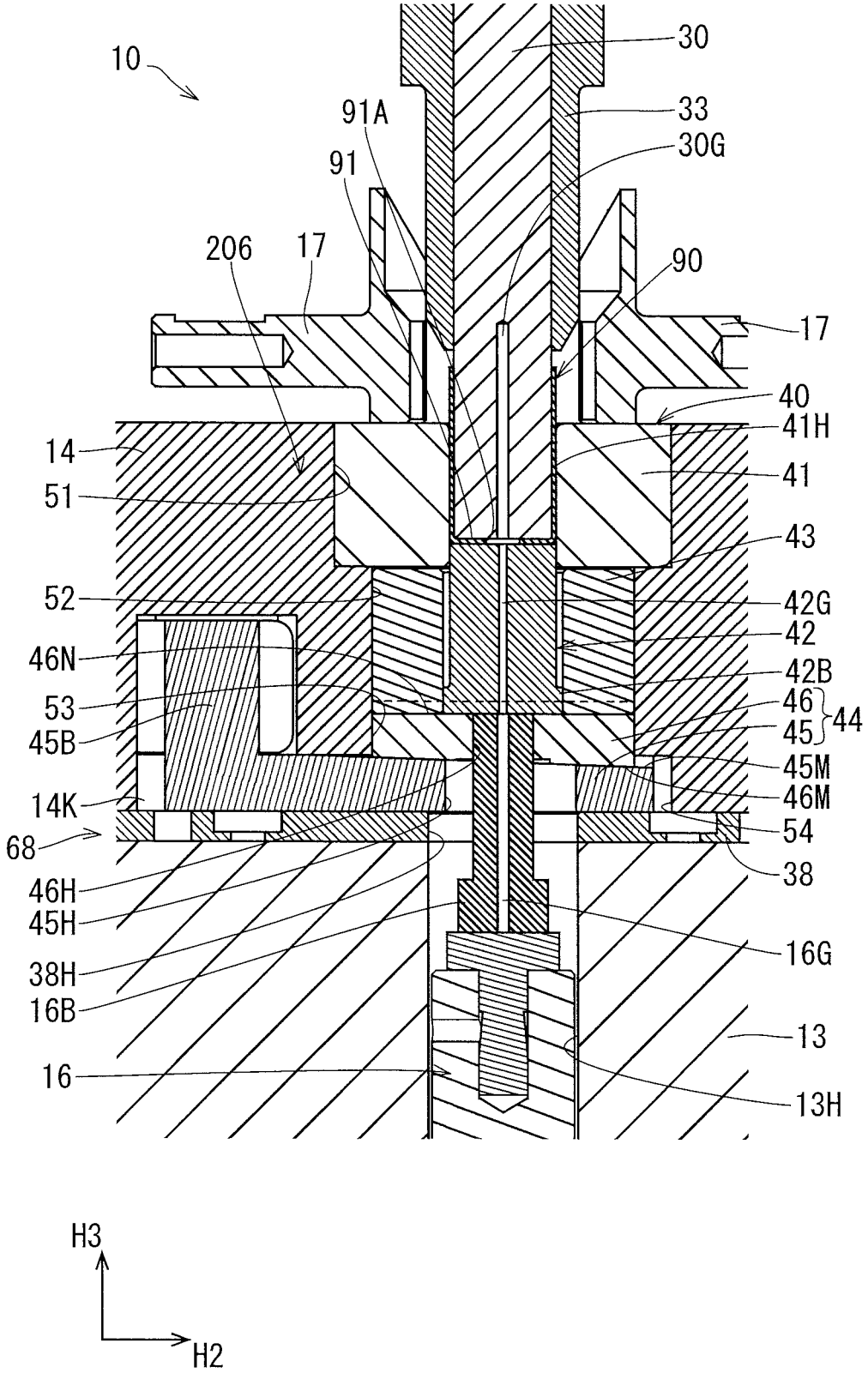
FIG. 4 is a sectional side view of a die holding portion of a bolster and a punch at a bottom dead center.

As illustrated in FIG. 4, the workpiece 90 formed by the pressing machine 10 of the present embodiment has, for example, a cylindrical shape with one end closed and the other end open, and has a through hole 91A at the center of a bottom wall 91. For the purpose of forming the workpiece 90, the plurality of punches 30 has a columnar shape, and the die 40 is provided with a punch receiving hole 41H having a circular cross section. Then, in each working stage ST, the punch 30 pushes the workpiece 90 into the punch receiving hole 41H of the die 40 for drawing, ironing, crushing, or the like. In addition, some of the working stages ST are provided with a mechanism for causing a tool to advance and retract toward and from the workpiece 90 in the front-rear direction H2. For example, a through hole or an engraved mark is formed on the workpiece 90 from the front, or an upper edge portion of the workpiece 90 is removed.

As illustrated in FIG. 4, a through hole 13H penetrating the bolster 13 in the vertical direction is provided coaxially with and below the punch receiving hole 41H of each die 40, and a knockout pin 16 is received in each through hole 13H. A lower end portion of the knockout pin 16 protrudes downward from the slit of the bolster support beam 203 described above. A position close to the lower end of the knockout pin 16 penetrates a support plate 203A (see FIG. 6) fixed to the bolster support beam 203. Furthermore, a compression coil spring 16C (see FIG. 6) is disposed around a portion of the knockout pin 16 above the level of the support plate 203A. Then, each knockout pin 16 is pushed and lowered by the punch 30 via the workpiece 90, and is also raised by elastic reaction force of the compression coil spring 16C and power received at the lower end portion as necessary. In the working stage ST for crushing of the bottom wall 91 of the workpiece 90 (see FIG. 4), as will be described in detail later, a movable die 42 is provided between the workpiece 90 and the knockout pin 16, and the knockout pin 16 presses the workpiece 90 toward the punch 30 via the movable die 42.

Figure 2:
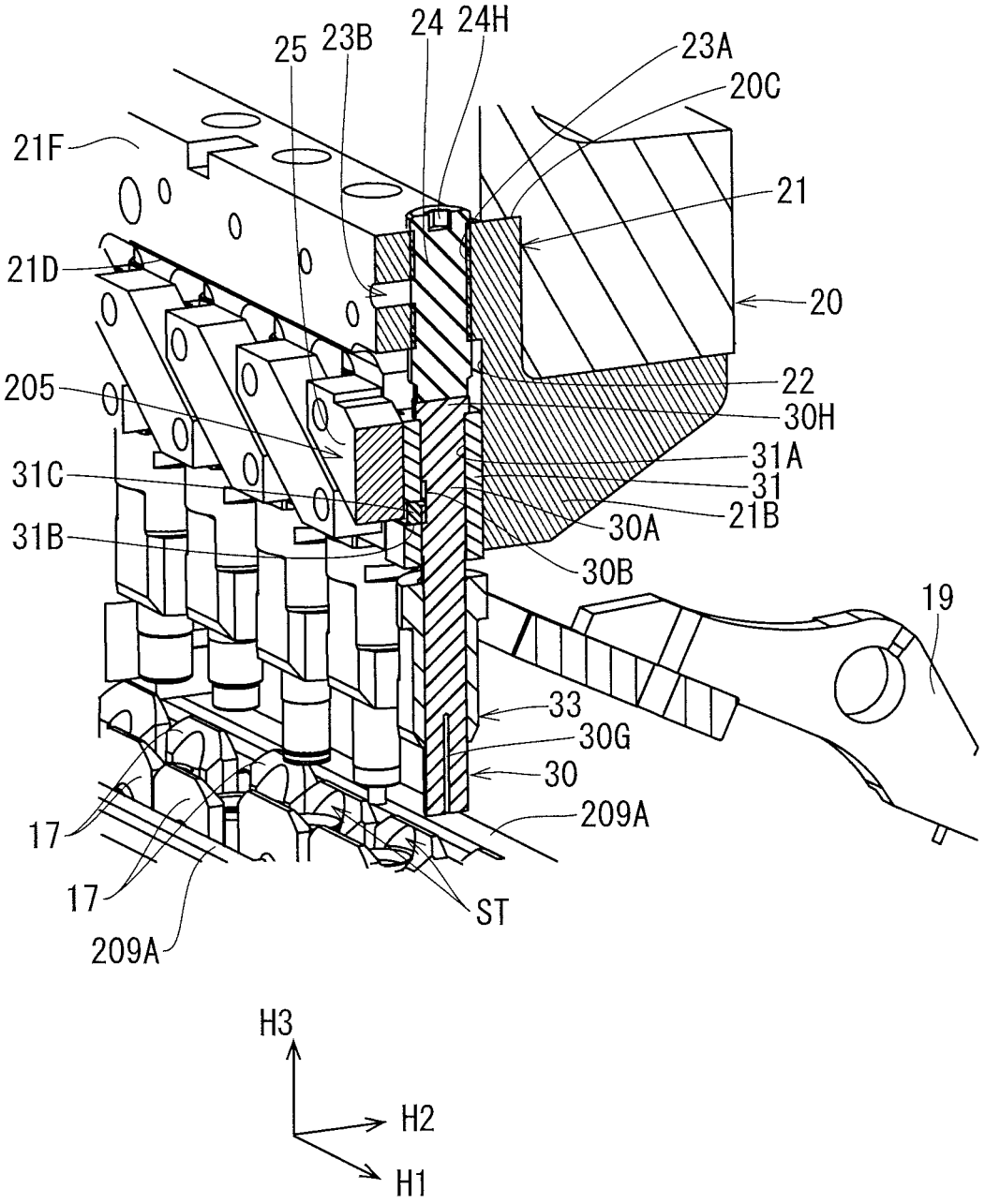
FIG. 2 is a partially broken perspective view of a die holding portion of a ram.

As illustrated in FIG. 2, a stripper 33 is fitted on an intermediate position in the vertical direction H3 of the punch 30. Then, the workpiece 90 which is discharged from the die 40 together with the punch 30, is separated from the punch 30 by the stripper 33. For this purpose, a lever 19 provided behind the bolster 13 is coupled to each stripper 33, and the stripper 33 is moved up and down with respect to the corresponding punch 30 by the lever 19 in synchronization with the up-and-down motion of the ram 20.

As illustrated in FIG. 1, the pressing machine 10 is provided with a workpiece conveying device 209 that conveys a workpiece 90 to each working stage ST. Note that the pressing machine that sequentially conveys the workpiece 90 to the plurality of working stages ST is generally called a "transfer pressing machine", and the workpiece conveying device 209 in this case is generally called a "transfer device".

The workpiece conveying device 209 has a pair of rails 209A (only one of the rails 209A is illustrated in FIG. 1) extending in the lateral direction H1 on the plurality of die holding portions 206 and facing each other in the front-rear direction H2. On the pair of rails 209A, a plurality of pairs of fingers 17 is arranged and supported in the lateral direction H1 at a constant pitch as illustrated in FIG. 2.

The pair of fingers 17 are biased toward each other by a coil spring (not illustrated). A lower end portion of the stripper 33 enters between the pair of fingers 17 from above or from a side, thereby opening the pair of fingers 17. Then, every time the ram 20 moves up and down, a motion in which the pair of rails 209A reciprocate in the lateral direction H1 is repeated, and each pair of fingers 17 grips the workpiece 90 and conveys the workpiece 90 to the right side in FIG. 1 by a certain pitch. Thus, the workpiece 90 generated by the workpiece feeder 18 is sequentially conveyed to each working stage ST, and machining is performed on the workpiece 90 at a plurality of times. Finally, the workpiece 90 is discharged from the working stage ST at the right end to, for example, a chute (not illustrated).

In the pressing machine 10 of the present embodiment, the workpiece feeder 18 and the working stage ST at the left end are separated by a distance of two pitches, and a dummy stage where machining is not performed is provided therebetween. The lever 19 that drives the workpiece conveying device 209, the workpiece feeder 18, and the stripper 33 is mechanically coupled to the cam shaft 71, and receives power from a servomotor 70, which is a power source used in common with the ram 20.

Meanwhile, the shape of the workpiece 90 slightly differs depending on a difference in positions where the punches 30 and the dies 40 are held by the die holding portions 205,206. Thus, the die holding portions 205 of the ram 20 are provided with a mechanism for adjusting the positions where the punches 30 are held. Hereinafter, a structure of the die holding portions 205 of the ram 20 will be described in detail.

As illustrated in FIG. 2, the plurality of die holding portions 205 of the ram 20 is provided on a support base 21 fixed to the bottom portion of the ram 20. The support base 21 has a vertical rear surface, and a rear protrusion 21B protrudes toward the rear from a lower portion of the rear surface. Then, the rear surface of the support base 21 is fitted to a lower portion of a front surface of the ram 20, and an upper surface of the rear protrusion 21B is fitted to a lower surface of the ram 20 and is fixed to the ram 20. The ram 20 has a stepped surface 20C formed by recessing a lower end portion of the front surface, and a rear edge portion of an upper surface of the support base 21 is fitted to the stepped surface 20C.

The support base 21 has a front surface having a stepped portion 21D at an intermediate position in the vertical direction, and a lower stage portion 21E (see FIG. 3) below the stepped portion 21D is recessed from an upper stage portion 21F which is located above.

As illustrated in FIG. 2, a plurality of screw holes 23A penetrating vertically is formed in the upper stage portion 21F of the support base 21 so as to be arranged at a constant pitch in the lateral direction H1. Then, an adjustment bolt 24 is screwed into each screw hole 23A, and a lower end portion thereof protrudes toward a longitudinal groove 22 described below. A tool engagement portion 24H (see FIG. 6) constituted by a hexagonal hole, a hexagonal shaft portion, or the like for engaging a tool for a screwing operation is formed at an upper end portion of the adjustment bolt 24. Moreover, the support base 21 has a plurality of screw holes 23B formed to communicate between a front surface of the upper stage portion 21F and the corresponding screw holes 23A, and set screws (not illustrated) are screwed into the screw holes 23B to prevent the adjustment bolt 24 from rotating.

Figure 3:
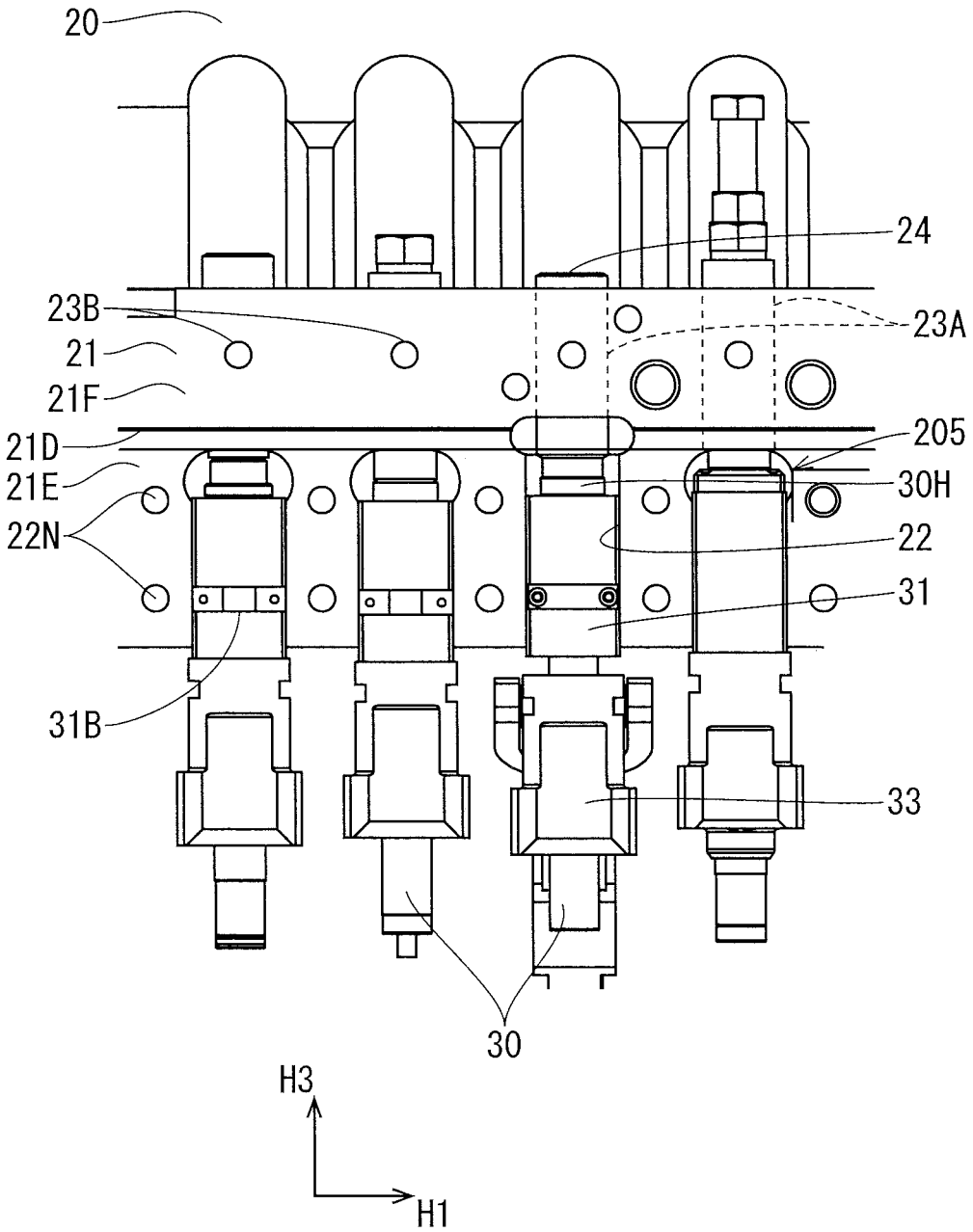
FIG. 3 is a front view of the die holding portion of the ram.

As illustrated in FIG. 3, a plurality of the longitudinal grooves 22 is formed immediately below the plurality of screw holes 23A in the lower stage portion 21E of the support base 21. The longitudinal grooves 22 have a square groove structure with a quadrangular cross section, and are open on the front side and the bottom side. A pair of screw holes 22N are arranged vertically between adjacent longitudinal grooves 22 in the lower stage portion 21E. Furthermore, although not illustrated, only a lower screw hole 22N of the pair of screw holes 22N described above is provided on the right of the longitudinal groove 22 at the right end, and only an upper screw hole 22N of the pair of screw holes 22N is provided on the left of the longitudinal groove 22 at the left end.

As illustrated in FIG. 2, an adapter 31 is received in each longitudinal groove 22. The adapter 31 is constituted by a circular through hole 31A formed at the center of a prismatic body extending in the vertical direction H3. A through hole 31B penetrating from a front surface to the through hole 31A is formed at a position in the middle in the vertical direction of the adapter 31, and part of a locking member 31C fitted thereto protrudes into the through hole 31A.

Each adapter 31 just fits in the corresponding longitudinal groove 22 in the lateral direction H1, and slightly protrudes toward the front from an opening on a front surface of the longitudinal groove 22. Then, for the purpose of fixing each adapter 31 to the corresponding longitudinal groove 22, a plurality of pressing members 25 extending obliquely from top left to bottom right as viewed from the front is disposed so as to obliquely cross the opening on the front surface of each longitudinal groove 22, and bolts (not illustrated) penetrating both ends of each pressing member 25 are screwed into the screw holes 22N described above.

Each punch 30 is fitted and held in the through hole 31A of the corresponding adapter 31 described above. The punch 30 extends from an upper end to at least a position close to a lower end with a circular cross section, and an upper portion of the punch 30 serves as a held portion 30A to be fitted in the through hole 31A of the adapter 31. A head portion 30H protrudes laterally from an upper end of the held portion 30A and is fitted to an upper surface of the adapter 31. Moreover, a locking groove 30B in the shape of a square groove extending in the vertical direction H3 is formed on a peripheral surface of the held portion 30A. Then, part of the locking member 31C described above is engaged with the locking groove 30B so that the punch 30 is prevented from rotating with respect to the adapter 31.

At the center of each punch 30, a gas release hole 30G extends from a distal end surface to a position close to the distal end, and a lateral hole (not illustrated) communicates between an upper end portion of the gas release hole 30G and an outer surface of the punch 30.

The plurality of die holding portions 205 of the ram 20 of the present embodiment is constituted by the adapter 31, the longitudinal groove 22, the pressing member 25, and the like described above. Then, the punch 30 is positioned in the vertical direction H3 with respect to the ram 20 by the adjustment bolt 24 disposed above each die holding portion 205.

In a case of adjusting the position of the punch 30 with respect to the ram 20, for example, the bolts fixing the pressing member 25 are loosened, and the punch 30 is set so as to abut on the adjustment bolt 24 slightly above a target position. Then, an operation of tightening the adjustment bolt 24 may be performed so that the adapter 31 is lowered together with the punch 30 and moved to the target position.

Next, the die holding portions 206 and the dies 40 of the bolster 13 will be described. Here, the plurality of dies 40 attached to the bolster 13 of the pressing machine 10 of the present embodiment includes a crushing die 40, a drawing die 40, and an ironing die 40. As illustrated in FIG. 4, the crushing die 40 is constituted by the fixed die 41 and a movable die 42, and the drawing die 40 and the ironing die 40 are constituted by only a fixed die 41.

Figure 5:
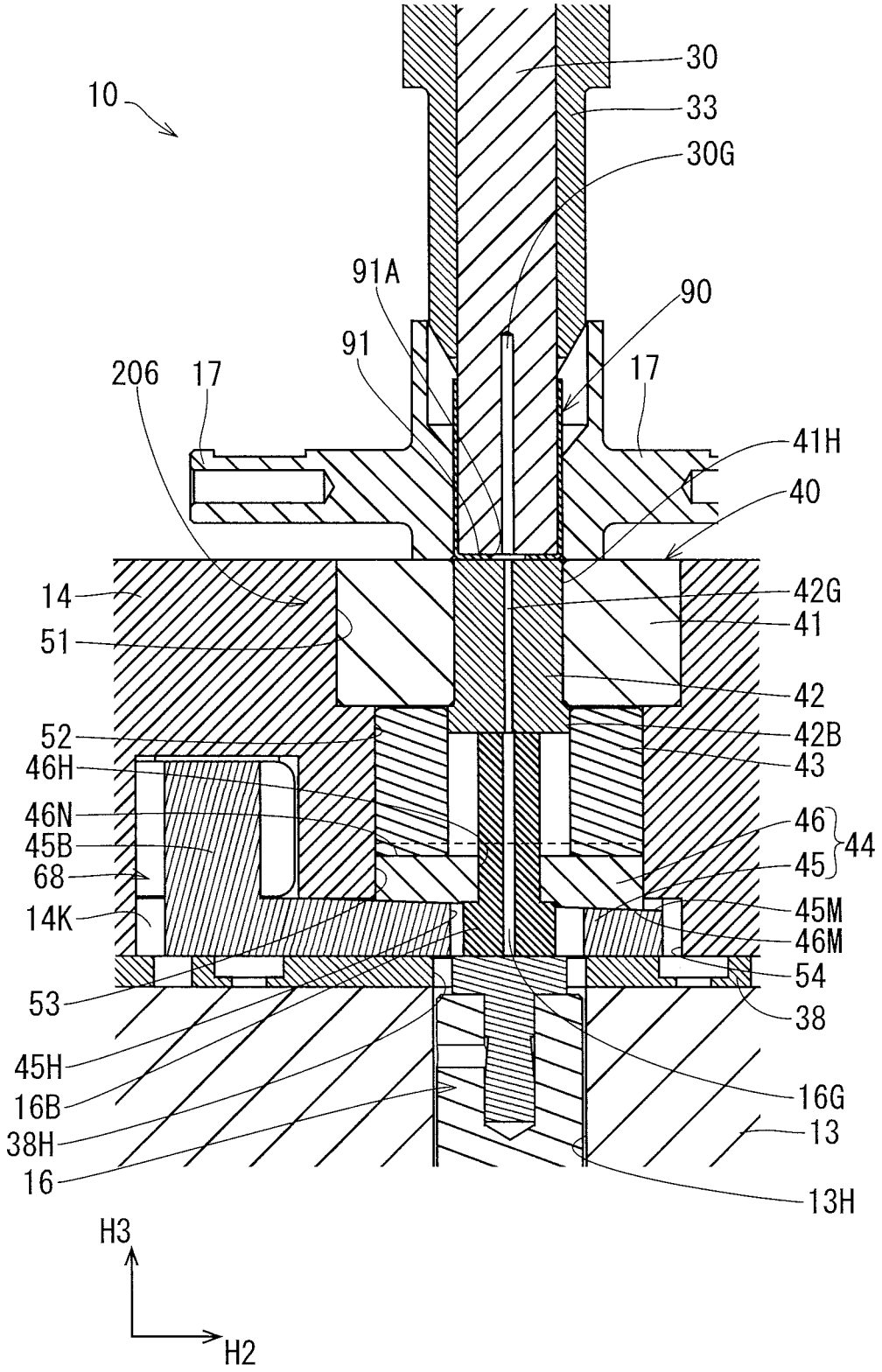
FIG. 5 is a sectional side view of the die holding portion of the bolster and a knockout pin at the bottom dead center.
Figure 6:
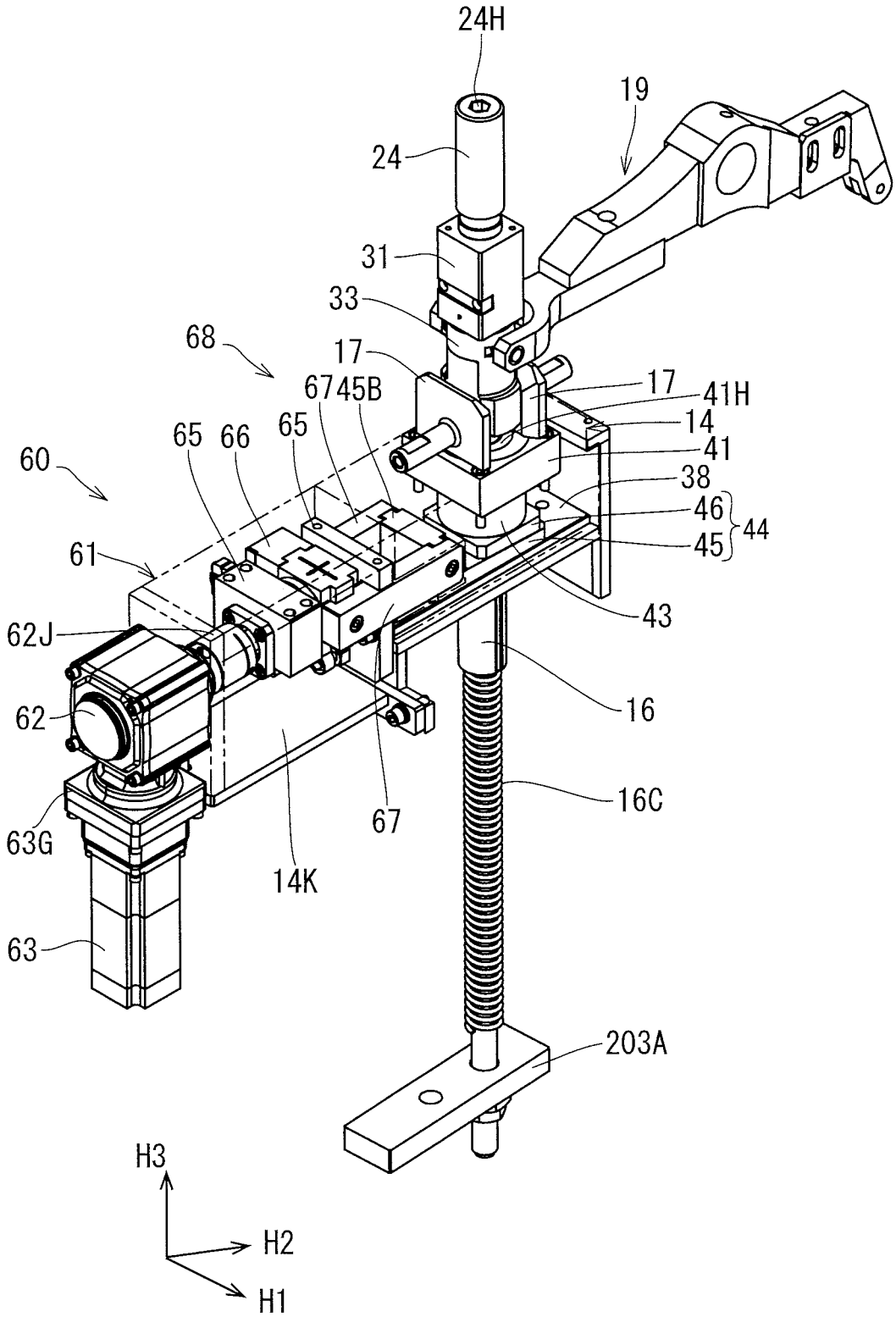
FIG. 6 is a perspective view of a position adjustment mechanism.

As illustrated in FIG. 6, the fixed die 41 has a rectangular parallelepiped shape, and the punch receiving hole 41H illustrated in FIG. 4 vertically penetrates the center thereof. The punch receiving hole 41H of each of the drawing die 40 and the ironing die 40 is reduced in diameter at an intermediate position in the axial direction, and is provided with a reduced diameter portion (not illustrated) for drawing or ironing the workpiece 90. On the other hand, the punch receiving hole 41H of the crushing die 40 is, for example, uniform in inner diameter. The die 40 illustrated in FIGS. 4 and 5 is the crushing die 40.

As illustrated in FIG. 4, the movable die 42 of the crushing die 40 has an upper portion that is just fitted in the punch receiving hole 41H and can be moved up and down, and has a lower end flange 42B protruding laterally from a lower end portion, so as not to come out upward from the punch receiving hole 41H. As illustrated in FIG. 5, a portion of the movable die 42 above the level of the lower end flange 42B is substantially the same in axial length as the punch receiving hole 41H.

As illustrated in FIG. 1, in order to provide the plurality of die holding portions 206 for holding the plurality of dies 40, for example, a recess 13B is formed on the upper surface of the bolster 13 by recessing the entire surface except for both ends in the lateral direction H1 in a stepped manner. Then, a plurality of support blocks 14 is housed and fixed side by side in the recess 13B.

As illustrated in FIG. 4, a die receiving recess 51 having a quadrangular planar shape is formed on an upper surface of each support block 14. A guide hole 52 vertically penetrating the support block 14 is formed at the center of a bottom surface of the die receiving recess 51, and screw holes (not illustrated) are formed at four corners of the bottom surface of the die receiving recess 51. Then, the fixed die 41 included in each die 40 just fits in the die receiving recess 51, and is fixed with a bolt. That is, the inside of the support block 14 serves as the die holding portion 206.

The guide hole 52 of the die holding portion 206 for crushing has an inner diameter larger than that of the punch receiving hole 41H of the die 40, and a guide sleeve 43 is fitted inside the guide hole 52. The guide sleeve 43 has a cylindrical shape that just fits in the guide hole 52, and has an inner diameter that is slightly larger than the inner diameter of the punch receiving hole 41H and is just the size for the lower end flange 42B of the movable die 42 to fit in. In addition, a slight gap is provided between an upper surface of the guide sleeve 43 and the fixed die 41. Moreover, a lower end portion of the guide sleeve 43 slightly protrudes into a square hole 53 which will be described below.

In the present embodiment, the guide sleeve 43 is fitted inside the guide hole 52 of the die holding portion 206, and the movable die 42 is slidably fitted in the guide sleeve 43 (corresponding to the "slide support portion" in the claims). Alternatively, a configuration may be adopted in which the guide sleeve 43 is not provided, the guide hole 52 of the die holding portion 206 has the same inner diameter as the guide sleeve 43, and the movable die 42 is slidably fitted directly to the guide hole 52.

The square hole 53 is formed coaxially with and below the guide hole 52. The square hole 53 has a planar shape that is, for example, a square in which a circle which is a planar shape of the guide hole 52, is inscribed as viewed in the vertical direction H3.

A second spacer 46 is fitted in the square hole 53. As illustrated in FIG. 6, the second spacer 46 has a square plate shape just fitted in the square hole 53, and a through hole 46H smaller than the inner diameter of the guide sleeve 43 is formed at the center thereof as illustrated in FIG. 4. An upper surface of the second spacer 46 serves as an abutting surface 46N perpendicular to central axes of the guide sleeve 43 and the movable die 42, and is in surface abutment with lower surfaces of the guide sleeve 43 and the movable die 42. On the other hand, a lower surface of the second spacer 46 serves as an abutting slope 46M having a slight inclination angle with respect to the central axes of the guide sleeve 43 and the movable die 42, and is inclined downward toward the rear in the front-rear direction H2, for example.

A stepped lower surface recess 54 is formed on a lower surface of the support block 14, and the square hole 53 is opened in an upper surface in the lower surface recess 54. A plate-shaped sliding metal 38 is fixed to a position of the bolster 13 facing the lower surface recess 54. Then, a first spacer 45 is received in the lower surface recess 54, and the first spacer 45 and the second spacer 46 described above constitute a spacer set 44 (corresponding to the "die positioning portion" and the "portion for die positioning" in the claims). The movable die 42 and the guide sleeve 43 are positioned at lower ends of their movable ranges in accordance with the position of an upper surface of the spacer set 44 (the abutting surface 46N of the second spacer 46).

Specifically, a lower surface of the first spacer 45 forms a flat surface perpendicular to the central axes of the guide sleeve 43 and the movable die 42, and is in surface abutment with an upper surface of the sliding metal 38. On the other hand, an upper surface of the first spacer 45 serves as an abutting slope 45M having a slight inclination angle with respect to the central axes of the guide sleeve 43 and the movable die 42, and is inclined downward toward the rear in the front-rear direction H2, so as to be in surface abutment with the abutting slope 46M of the second spacer 46. The lower surface recess 54 has a pair of opposing surfaces (not illustrated) parallel to the front-rear direction H2, and the first spacer 45 is guided by the pair of opposing surfaces to slide in the lower surface recess 54.

Then, the first spacer 45 moves toward the rear in the lower surface recess 54, and the abutting slopes 45M and 46M of the first spacer 45 and the second spacer 46 come into sliding contact with each other, so that the upper surface of the second spacer 46 (that is, the upper surface of the spacer set 44) is raised. On the other hand, the first spacer 45 moves toward the front in the lower surface recess 54, and the abutting slopes 45M and 46M of the first spacer 45 and the second spacer 46 come into sliding contact with each other, so that the upper surface of the second spacer 46 (that is, the upper surface of the spacer set 44) is lowered, and the positions where the movable die 42 and the guide sleeve 43 are positioned by the spacer set 44 are changed.

As illustrated in FIG. 4, a movable component housing space 14K communicating with the lower surface recess 54 is formed in the support block 14 on the front side of the guide hole 52. Then, the movable component housing space 14K receives a coupling wall 45B standing upright from a front end portion of the first spacer 45.

As illustrated in FIG. 6, a support housing 61 is fixed to a front surface of the support block 14, and the movable component housing space 14K is also provided in the support housing 61. Then, rear end portions of a pair of coupling beams 67 extending in the front-rear direction H2 across the support block 14 and the support housing 61 are fixed to both side portions of the coupling wall 45B, and a movement amount confirming member 66 is fixed in a state of being sandwiched between front end portions of the pair of coupling beams 67. A nut (not illustrated) is fixed to the movement amount confirming member 66, and a screw portion provided on an outer surface of a rotation shaft (not illustrated) extending in the front-rear direction H2 is screwed into the nut. The support housing 61 is provided with a pair of shaft support walls 65 so that the movable component housing space 14K is partitioned in the front-rear direction H2. Then, the movement amount confirming member 66 is disposed between the pair of shaft support walls 65, and a rear end portion and a position close to a front end of the rotation shaft are rotatably supported by the pair of shaft support walls 65 so as not to be movable in the front-rear direction H2.

In addition, a bevel gear unit 62 is fixed to a front surface of the support housing 61, an output portion of the bevel gear unit 62 and a front end portion of the rotation shaft are coupled by a joint 62J, and a servomotor 63 is coupled to an input shaft (not illustrated) provided on a lower surface of the bevel gear unit 62 via a speed reducer 63G. With this arrangement, the first spacer 45 is slid in the front-rear direction H2 by the servomotor 63, and the position of a bottom dead center of the movable die 42 in the vertical direction H3 can be adjusted. That is, in the pressing machine 10 of the present embodiment, the servomotor 63, the first spacer 45, the second spacer 46, the nut, the rotation shaft, and the like constitute a position adjustment mechanism 68 that adjusts the position of the movable die 42.

As illustrated in FIG. 4, in the sliding metal 38 and the first spacer 45, through holes 38H and 45H larger than the through hole 46H of the second spacer 46 are formed at positions facing the through hole 46H. Then, an upper end portion of the knockout pin 16 abuts against the lower surface of the movable die 42 via the through holes 38H, 45H, and 46H.

In a head portion 16B of the knockout pin 16 and the entire movable die 42, gas release holes 16G and 42G are formed at the center and communicate with each other. A lateral hole (not illustrated) is formed at a lower end portion of the head portion 16B so as to communicate between an outer surface and a lower end portion of the gas release hole 16G.

Although not illustrated, the die holding portion 206 for drawing and ironing is similar to a die holding portion for drawing and ironing of a conventional pressing machine. As an example, the following configuration is adopted, for example. Specifically, the guide hole 52 of the die holding portion 206 for drawing and ironing is slightly larger than the punch receiving hole 41H of the die 40, and does not house the guide sleeve 43. The guide hole 52 extends to the lower surface of the support block 14, and the square hole 53, the first spacer 45, the second spacer 46, and the sliding metal 38 described above are not provided below the guide hole 52. Then, the head portion 16B of the knockout pin 16 enters the punch receiving hole 41H through the guide hole 52.

Figure 7:
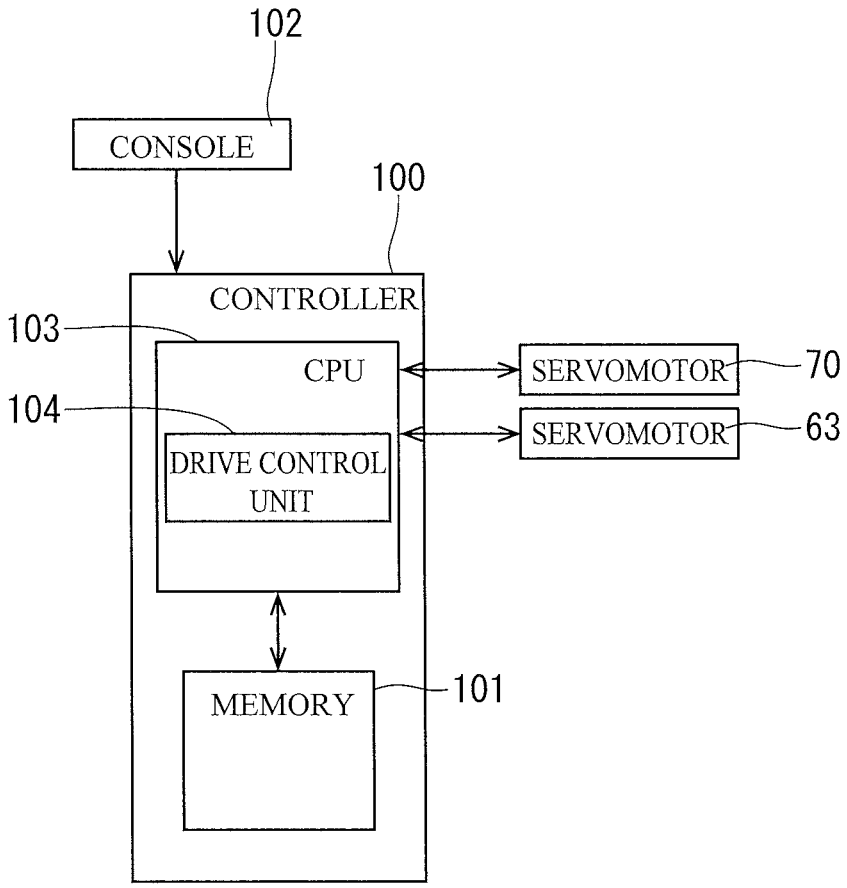
FIG. 7 is a block diagram of a control system of the pressing machine.

The position adjustment mechanism 68 described above can be operated by a controller 100 of the pressing machine 10. Specifically, as illustrated in FIG. 7, a memory 101 of the controller 100 stores data regarding a rotation amount of the servomotor 63 corresponding to an amount of movement of the upper surface of the spacer set 44 in the vertical direction H3. Then, when the amount of movement of the upper surface of the spacer set 44 in the vertical direction H3 is input as position change data in a console 102 (corresponding to the "setting operation unit" in the claims) of the controller 100, a CPU 103 of the controller 100 functions as a drive control unit 104, and a target rotation amount of the servomotor 63 corresponding to the position change data is determined. Then, an output portion of the servomotor 63 is rotationally driven so as to move to a target position, which is away from the current rotational position by the target rotation amount. Thus, the upper surface of the spacer set 44 is moved upward or downward from the current position corresponding to the input position change data, and the position where the movable die 42 is positioned by the spacer set 44 is changed.

In addition, when the position change data is given during continuous operation of the pressing machine 10, the drive control unit 104 drives the servomotor 63 while reaction force due to press working from the movable die 42 is not applied to the spacer set 44 in a state where the continuous operation is continued. Specifically, while the rotational position of the cam shaft 71 is within a prescribed range (e.g., a range of −120 to +60) from the position where the ram 20 is at a top dead center, the drive control unit 104 starts driving the servomotor 63, and ends the driving of the servomotor 63 before the ram 20 reaches a bottom dead center.

Note that a movable range of the movable die 42 in the vertical direction H3 by the position adjustment mechanism 68 of the present embodiment is 1 [mm] or less, and resolution of that movement is 0.1 [mm] or less (e.g., in units of 0.01 [mm]). By not increasing the movable range of the press die more than necessary, it is possible to downsize the position adjustment mechanism.

This concludes the description of the configuration of the pressing machine 10 of the present embodiment. Next, functional effects of the pressing machine 10 of the present embodiment will be described. The workpiece 90 manufactured by the pressing machine 10 of the present embodiment is managed by, for example, whether the thickness of the bottom wall 91 is within tolerance with respect to a design value. As a preparation for continuous operation of the pressing machine 10, for example, the upper surface of the spacer set 44 is disposed in the middle of its movable range, and several workpieces 90 are manufactured as prototypes by the pressing machine 10. Then, the thicknesses of the bottom walls 91 of the several workpieces 90 are actually measured, and in a case where the difference between the actual measurement value and the design value exceeds a reference value, the position of the punch 30 is adjusted by the adjustment bolt 24 of the working stage ST having the position adjustment mechanism 68 so that the difference does not exceed the reference value. Then, after the adjustment, the pressing machine 10 is continuously operated, and the workpieces 90 are mass-produced as pressed products. Also during the continuous operation, the thickness of the bottom wall 91 of the workpiece 90 is actually measured as a sample every time the number of pressed products manufactured reaches a predetermined number.

Meanwhile, while the pressing machine 10 is continuously operated, for example, the punch 30 or the movable die 42 may be thermally deformed by frictional heat and gradually extend in the vertical direction H3, and the bottom wall 91 of the workpiece 90 may gradually become thinner than that at the beginning of the continuous operation of the pressing machine 10. For some reason, the bottom wall 91 of the workpiece 90 may become thicker than that at the beginning of the continuous operation of the pressing machine 10.

In such a case, for the purpose of making the thickness of the bottom wall 91 of the workpiece 90 closer to the design value, position change data for reducing the difference between the actual measurement value and the design value of the thickness of the bottom wall 91 may be input to the controller 100 in the console 102. Specifically, in a case where the difference of the actual measurement value with respect to the design value of the bottom wall 91 is +0.3 [mm], for example, −0.3 [mm] may be input to the controller 100 as position change data. Then, while the ram 20 is away from the bottom dead center, the drive control unit 104 drives the servomotor 63 to slide the first spacer 45 to the rear side, so that the upper surface of the spacer set 44 is raised by 0.3 [mm]. In a case where the difference of the actual measurement value with respect to the design value of the bottom wall 91 is −0.2 [mm], for example, +0.2 [mm] may be input to the controller 100 as position change data. Then, while the ram 20 is away from the bottom dead center, the drive control unit 104 drives the servomotor 63 to slide the first spacer 45 to the front side, so that the upper surface of the spacer set 44 is lowered by 0.2 [mm]. With this arrangement, the thickness of the bottom wall 91 of the workpiece 90 is made closer to the design value.

As described above, according to the pressing machine 10 and the pressed product manufacturing method using the pressing machine 10 of the present embodiment, it is possible to quickly and easily perform operation of correcting the position of a press die (movable die 42) in the die holding portion 206 without performing conventional troublesome manual work of loosening holding of the press die by the die holding portion and adjusting the position of the press die, and it is possible to improve the production efficiency and reduce a manufacturing cost as compared with a conventional art. Moreover, the correction can be performed in a state where continuous operation of the pressing machine 10 is maintained, and this greatly improves the production efficiency. In addition, the position correction is performed when reaction force due to press working from the movable die 42 is not applied to the spacer set 44, and this stabilizes results of the position correction on the dimensions of the workpiece 90.

Second Embodiment

Figure 8:
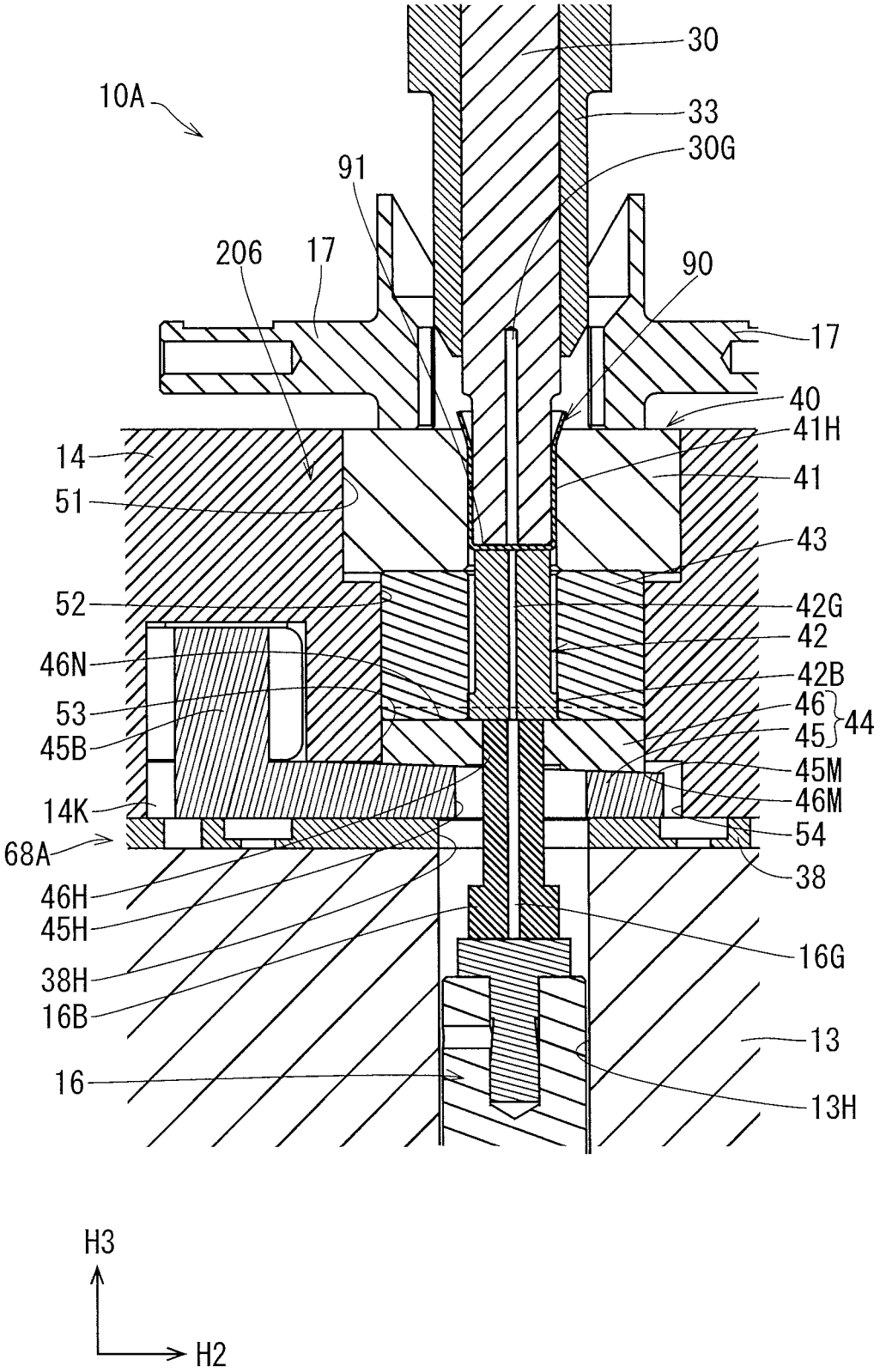
FIG. 8 is a sectional side view of a position adjustment mechanism of a pressing machine according to a second embodiment.

A pressing machine 10A of the present embodiment is illustrated in FIG. 8, and includes a position adjustment mechanism 68A which is different from that of the pressing machine 10 of the first embodiment. The position adjustment mechanism 68A is different from the position adjustment mechanism 68 of the first embodiment only in that a guide sleeve 43 slightly protrudes toward a die receiving recess 51 of a support block 14. Then, the position adjustment mechanism 68A changes both of the positions where a fixed die 41 and a movable die 42 are positioned by the spacer set 44.

Third Embodiment

Figure 9:
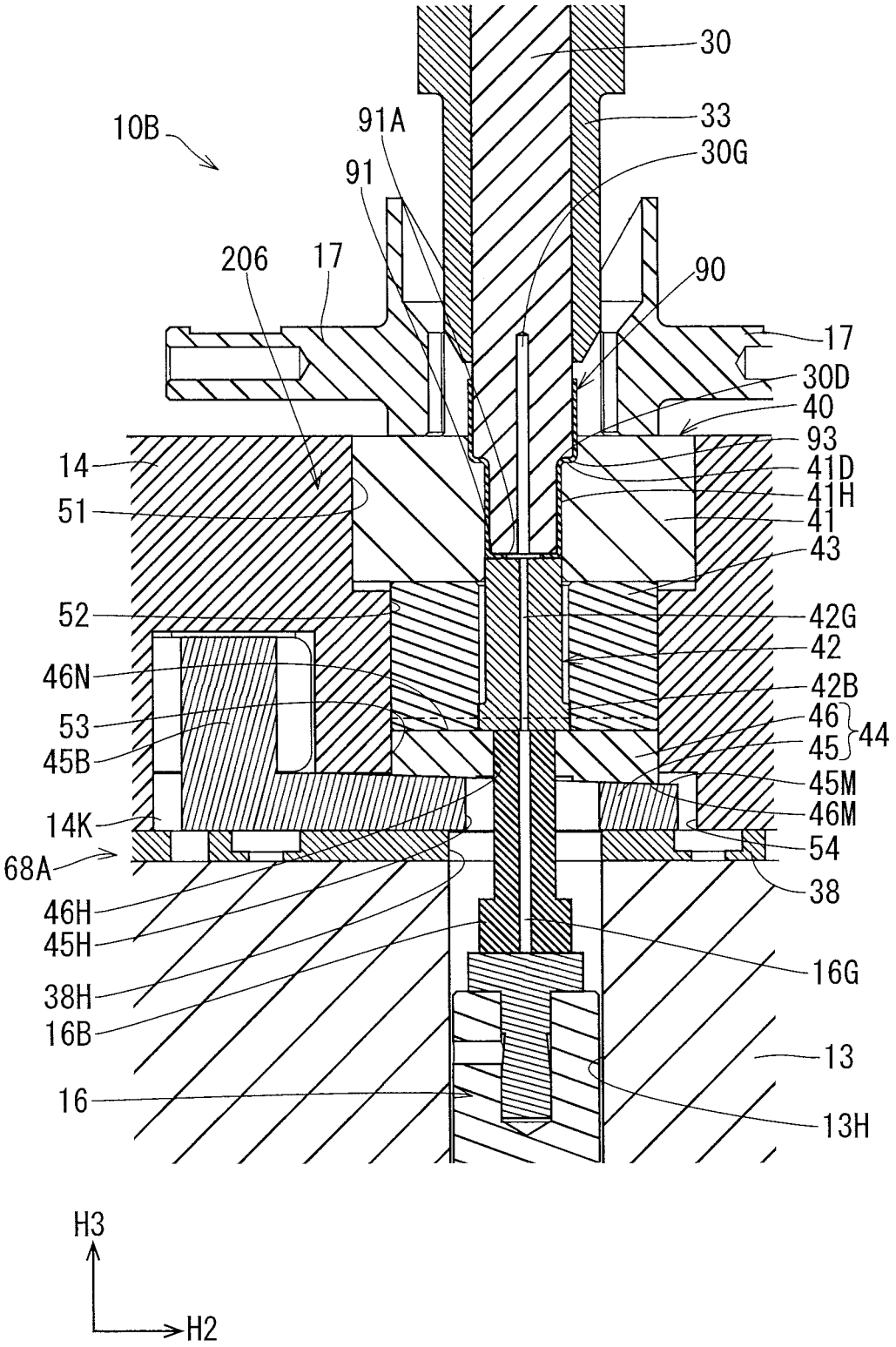
FIG. 9 is a sectional side view of a position adjustment mechanism of a pressing machine according to a third embodiment.

A pressing machine 10B of the present embodiment is illustrated in FIG. 9, and in the pressing machine 10A of the second embodiment, a stepped portion 41D is provided on an inner surface of a punch receiving hole 41H of a fixed die 41, the position of which can be adjusted by the position adjustment mechanism 68A, and a stepped portion 30D is provided on an outer surface of a punch 30. In addition to a bottom wall 91 of a workpiece 90, a stepped wall 93 provided at an intermediate position in the axial direction of the workpiece 90 is sandwiched between the stepped portions 30D and 41D of the punch 30 and the fixed die 41 for crushing.

Fourth Embodiment

Figure 10:
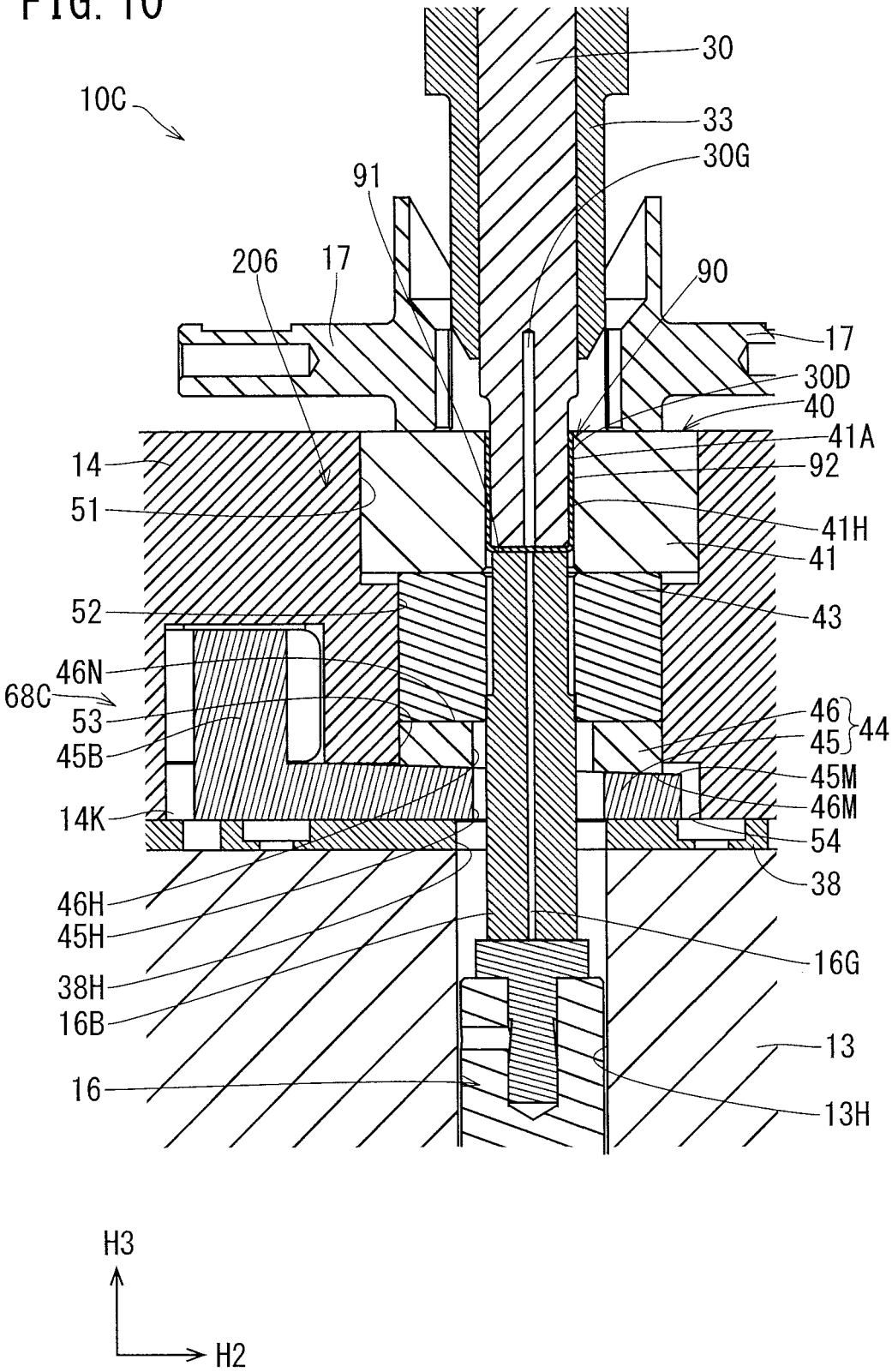
FIG. 10 is a sectional side view of a position adjustment mechanism of a pressing machine according to a fourth embodiment.

A pressing machine 10C of the present embodiment is illustrated in FIG. 10, and is provided with a position adjustment mechanism 68C in any of working stages ST for performing, for example, drawing or ironing of the pressing machine 10 of the first embodiment. A through hole 46H having an inner diameter larger than that of a guide sleeve 43 is formed in a second spacer 46 of the position adjustment mechanism 68C. Then, a head portion 16B of a knockout pin 16 passes through the inside of the guide sleeve 43, and abuts on a bottom wall 91 of a workpiece 90. According to the pressing machine 10C of the present embodiment, it is possible to change the position of a drawing or ironing die 40 constituted by only a fixed die 41 with respect to a bolster 13, thereby adjusting the amount by which a punch 30 pushes the fixed die 41 into a punch receiving hole 41H.

Fifth Embodiment

Figure 11:
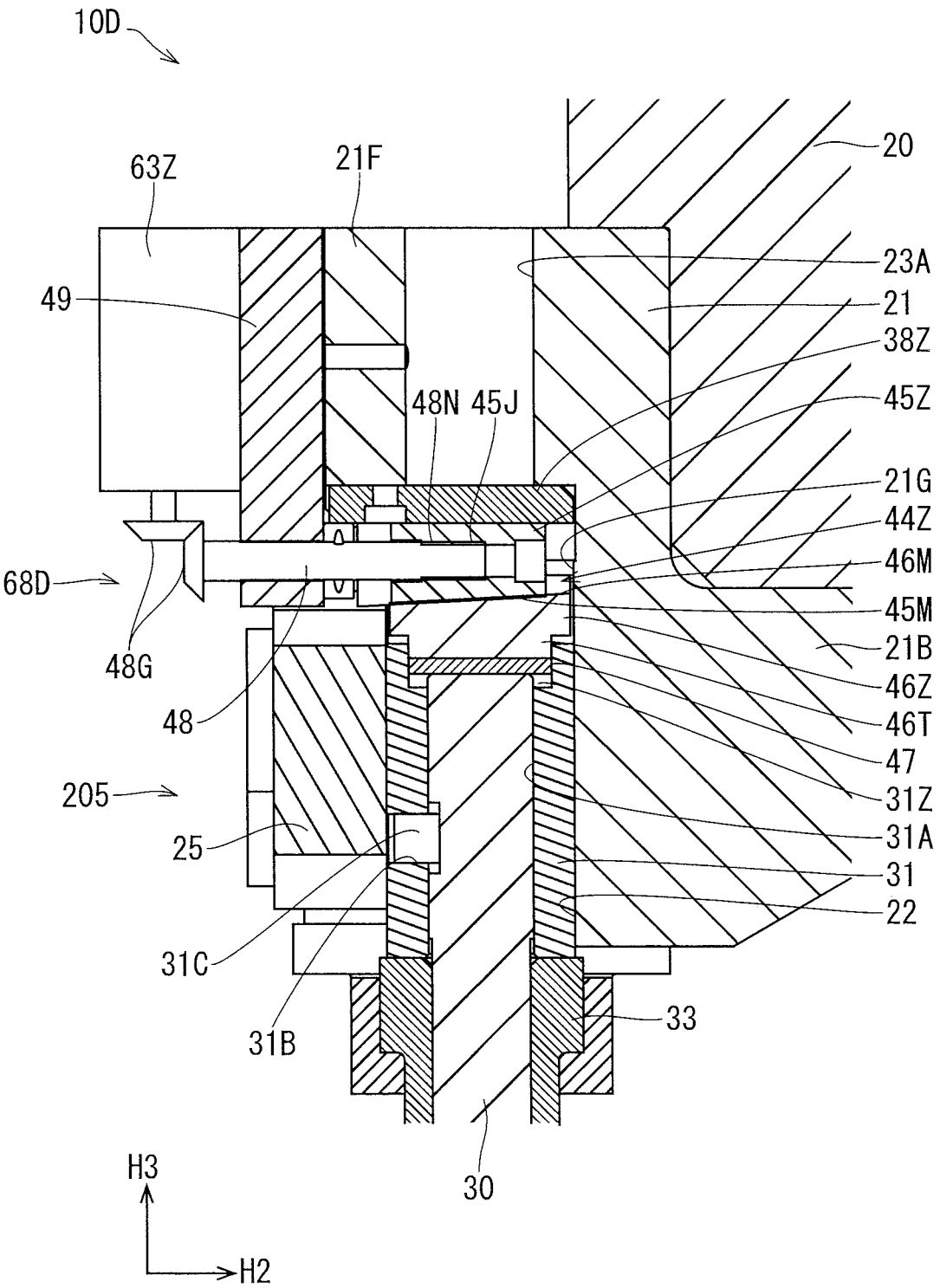
FIG. 11 is a sectional side view of a position adjustment mechanism of a pressing machine according to a fifth embodiment.

A pressing machine 10D of the present embodiment is illustrated in FIG. 11, and is provided with a position adjustment mechanism 68D on a ram 20 side instead of the position adjustment mechanism 68 on the bolster 13 side of the pressing machine 10 of the first embodiment. In a die holding portion 205 having the position adjustment mechanism 68D on the ram 20 side, an upper portion of the lower stage portion 21E (see FIG. 3) of the support base 21 described in the first embodiment is cut off, and a recess 21G is formed between the lower stage portion 21E and the upper stage portion 21F, and houses a spacer set 44Z of the position adjustment mechanism 68D and a sliding metal 38Z. The spacer set 44Z corresponds to the "die positioning portion" and the "punch positioning portion" in the claims, and is constituted by a first spacer 45Z, a second spacer 46Z fitted thereunder, and an auxiliary spacer 47 fitted further thereunder.

The second spacer 46Z has, for example, a quadrangular planar shape, and is provided with a lower surface protrusion 46T having a circular cross section protruding downward. Then, the lower surface protrusion 46T is fitted in a spacer fitting portion 31Z formed by expanding an upper portion of a through hole 31A of an adapter 31. The auxiliary spacer 47 has a disk shape, is fitted in the spacer fitting portion 31Z, and is fitted to a lower surface of the lower surface protrusion 46T. Then, an upper end portion of a punch 30 slightly protrudes into the spacer fitting portion 31Z and abuts on the auxiliary spacer 47. Each of a lower surface of the second spacer 46Z, an upper surface and a lower surface of the auxiliary spacer 47, and an upper surface of the punch 30 forms a horizontal plane perpendicular to a vertical direction H3, which is a moving direction of the ram 20.

The first spacer 45Z has, for example, a quadrangular planar shape. Both side surfaces of the first spacer 45Z and the second spacer 46Z are disposed flush with each other, and are adjacent to both inner side surfaces (not illustrated) of the recess 21G. Then, a lower surface of the first spacer 45Z and an upper surface of the second spacer 46Z are in surface abutment with each other as abutting slopes 45M and 46M both inclined with respect to the vertical direction H3 and a front-rear direction H2. The sliding metal 38Z is fitted and fixed to a lower surface of the upper stage portion 21F, which is also an upper surface in the recess 21G. Then, an upper surface of the first spacer 45Z and a lower surface of the sliding metal 38Z both form a horizontal plane perpendicular to the vertical direction H3 and are in surface abutment with each other.

With this arrangement, the first spacer 45Z moves in the front-rear direction H2, so that the second spacer 46Z moves in the vertical direction H3.

For the purpose of moving the first spacer 45Z, a screw hole 45J extending in the front-rear direction H2 is formed in the first spacer 45Z, and a screw portion 48N provided at a rear end portion of a rotation shaft 48 is screwed into the screw hole 45J. The rotation shaft 48 is rotatably supported, at a position close to a front end, so as not to be movable in the front-rear direction H2, by a bracket 49 fixed to a front surface of the upper stage portion 21F. A servomotor 63Z is attached to a front surface of the bracket 49, and a rotation output portion of the servomotor 63Z and a front end portion of the rotation shaft 48 are coupled via a pair of bevel gears 48G.

With the above configuration, the position of the punch 30 with respect to the ram 20 can be changed by the servomotor 63Z, and functional effects similar to those of the first embodiment are obtained. In addition, the spacer set 44Z is provided with the auxiliary spacer 47 separately from the first spacer 45Z and the second spacer 46Z, and this makes it possible to easily handle a plurality of types of workpieces by changing the auxiliary spacer 47.

Other Embodiments (1) In the first embodiment, an operator determines position change data on the basis of an actual measurement result of a designated location of a workpiece 90, and manually inputs the position change data to the controller 100. Alternatively, the designated location of the workpiece 90 may be automatically actually measured, and then the position change data may be automatically determined on the basis of the actual measurement result and given to the drive control unit 104. In this case, instead of actual measurement of the designated location of the workpiece 90, the position change data may be automatically determined on the basis of measurement of a temperature of a punch 30 or a die 40 or the number of times a ram 20 moves up and down as a substitute value for the actual measurement.

(2) The cylindrical workpiece 90 of the first embodiment has a circular planar cross section, but the planar cross section may be elliptical or polygonal (e.g., a quadrangle or a hexagon). The workpiece 90 may not have a cylindrical shape, and may have, for example, a shallow dish shape or a plate shape.

(3) In each of the above embodiments, the nut and the rotation shaft are provided as main components as a "motion conversion mechanism" that converts a rotational output of the servomotor 63 or 63Z into a relative movement between the first spacer 45 or 45Z and the second spacer 46 or 46Z. Alternatively, the "motion conversion mechanism" may be a ball screw mechanism, a cam mechanism, or a crank mechanism.

(4) In the position adjustment mechanisms 68, 68A, 68C, and 68D of the embodiments, after the rotational output of the servomotor 63 has been converted into a linear movement of the first spacer 45 in the direction (front-rear direction H2) perpendicular to the moving direction of the ram 20 by the "motion conversion mechanism" described above, the linear movement is converted into a linear movement in the moving direction of the ram 20 by sliding between the first spacer 45 and the second spacer 46, and the position where the press die (punch 30 and die 40) is positioned by the die positioning portion (spacer set 44 or 44Z) is changed. Alternatively, the rotational output of the servomotor 63 may be converted into a linear movement in the moving direction of the ram 20 by the "motion conversion mechanism" described above, and the position where the press die (punch 30 and die 40) is positioned by the die positioning portion (spacer set 44 or 44Z) may be changed. However, in a case of a configuration in which the direction of the linear movement is changed by the first spacer 45 and the second spacer 46 as in the embodiments, transmission of reaction force due to press working is suppressed between the first spacer 45 and the second spacer 46, and load on the servomotor 63 can be reduced.

(5) In the pressing machine 10 of the first embodiment, the position of the press die is corrected by the position adjustment mechanism 68 during continuous operation of the pressing machine 10. Alternatively, the correction may be performed while the pressing machine 10 is stopped.

(6) In the pressing machine 10 of the first embodiment, the position adjustment mechanism 68 is provided only in one die holding portion 206, but may be provided in a plurality of die holding portions.

REFERENCE SIGNS LIST

10, 10A to 10D Pressing machine
13 Bolster
16 Knockout pin
20 Ram
30 Punch
40 Die
41 Fixed die
42 Movable die
44, 44Z Spacer set
45, 45Z First spacer
45M, 46M Abutting slope
46, 46Z Second spacer
47 Auxiliary spacer
63, 63Z Servomotor
68, 68A, 68C, 68D Position adjustment mechanism
90 Workpiece
91 Bottom wall
104 Drive control unit
205, 206 Die holding portion
209 Workpiece conveying device
209A Rail
H2 Front-rear direction (second direction)
H3 Vertical direction (first direction)
ST Working stage

The invention claimed is:

1. A pressing machine comprising:

a first press die portion;

a second press die portion, the first press die portion and second press die portion being configured to press a workpiece between the first press die portion and the second press die portion;

a bolster that includes a first die holding portion that holds the first press die portion;

a ram that repeats an up-and-down motion in a continuous operation, the ram including a second die holding portion that holds the second press die portion;

a die positioning portion that positions the first press die portion or the second press die portion in a first direction which is a moving direction of the ram;

a position adjustment mechanism that has a servomotor as a drive source and is configured to change a position where the first press die portion or the second press die portion is positioned by the die positioning portion; and a controller that is configured to drive the servomotor, wherein, when position change data is given during the continuous operation, the controller drives the servomotor in such a way that the position where the first press die portion or the second press die portion is positioned by the die positioning portion is changed, during the continuous operation, to a position corresponding to the position change data, the controller being configured to start driving of the servomotor from a position where the ram is away from a bottom dead center, and to end the driving of the servomotor before the ram reaches the bottom dead center.

2. The pressing machine according to claim 1, further comprising:

a setting operation unit that is operated to give the position change data to the controller.

3. The pressing machine according to claim 2, wherein the die positioning portion includes: a spacer set that has a first spacer and a second spacer fitted to each other in the first direction, the spacer set being (i) between the bolster and the first press die portion or (ii) between the ram and the second press die portion; and a pair of abutting slopes that are provided in the first spacer and the second spacer, being in surface abutment with each other, and inclined with respect to both the first direction and a second direction perpendicular to the first direction; and the position adjustment mechanism includes a motion conversion mechanism that converts a rotational output of the servomotor into a relative movement between the first spacer and the second spacer in the second direction.

4. The pressing machine according to claim 3, wherein the spacer set is provided with an auxiliary spacer whose both front and back surfaces in the first direction are planes perpendicular to the first direction, and one of the front and back surfaces is in surface abutment with the first spacer or the second spacer.

5. The pressing machine according to claim 2, wherein a plurality of the first press die portions and a plurality of the second press die portions are disposed side by side in pairs at equal intervals, the pressing machine further comprises a workpiece conveying device that sequentially moves the workpiece to an adjacent one of the pairs in synchronization with a motion of the ram, and the position adjustment mechanism is provided in one or more of the pairs.

6. The pressing machine according to claim 1, wherein the die positioning portion includes: a spacer set that has a first spacer and a second spacer fitted to each other in the first direction, the spacer set being (i) between the bolster and the first press die portion or (ii) between the ram and the second press die portion; and a pair of abutting slopes that are provided in the first spacer and the second spacer, being in surface abutment with each other, and inclined with respect to both the first direction and a second direction perpendicular to the first direction; and the position adjustment mechanism includes a motion conversion mechanism that converts a rotational output of the servomotor into a relative movement between the first spacer and the second spacer in the second direction.

7. The pressing machine according to claim 6, wherein the spacer set is provided with an auxiliary spacer whose both front and back surfaces in the first direction are planes perpendicular to the first direction, and one of the front and back surfaces is in surface abutment with the first spacer or the second spacer.

8. The pressing machine according to claim 7, wherein a plurality of the first press die portions and a plurality of the second press die portions are disposed side by side in pairs at equal intervals, the pressing machine further comprises a workpiece conveying device that sequentially moves the workpiece to an adjacent one of the pairs in synchronization with a motion of the ram, and the position adjustment mechanism is provided in one or more of the pairs.

9. The pressing machine according to claim 6, wherein the second press die portion is a punch extending in the first direction, the first press die portion includes (i) a fixed die that has a punch receiving hole into and from which the punch advances and retracts and (ii) a movable die that linearly moves inside the punch receiving hole, a space being defined between the punch, the fixed die, and the movable die such that the workpiece is deformed into a cylindrical structure with one end closed, the die positioning portion is between the punch and the ram, and the position adjustment mechanism drives the die positioning portion to adjust a position of the punch relative to the ram in the first direction, and the pressing machine further comprises a knockout pin that presses the movable die toward the ram, thereby discharging the workpiece from the punch receiving hole.

10. The pressing machine according to claim 6, wherein a plurality of the first press die portions and a plurality of the second press die portions are disposed side by side in pairs at equal intervals, the pressing machine further comprises a workpiece conveying device that sequentially moves the workpiece to an adjacent one of the pairs in synchronization with a motion of the ram, and the position adjustment mechanism is provided in one or more of the pairs.

11. The pressing machine according to claim 6, wherein the second press die portion is a punch extending in the first direction, the first press die portion includes (i) a fixed die that has a punch receiving hole into and from which the punch advances and retracts and (ii) a movable die that linearly moves inside the punch receiving hole, a space being defined between the punch, the fixed die, and the movable die such that the workpiece is deformed into a cylindrical structure with one end closed, the die positioning portion positions the movable die at a bottom dead center that is at a position farthest from the ram in a movable range of the movable die, and the position adjustment mechanism drives the die positioning portion to adjust a position of the bottom dead center, and the pressing machine further comprises a knockout pin that presses the movable die toward the ram, thereby discharging the workpiece from the punch receiving hole.

12. The pressing machine according to claim 1, wherein the second press die portion is a punch extending in the first direction, the first press die portion includes (i) a fixed die that has a punch receiving hole into and from which the punch advances and retracts and (ii) a movable die that linearly moves inside the punch receiving hole, a space being defined between the punch, the fixed die, and the movable die such that the workpiece is deformed into a cylindrical structure with one end closed, the die positioning portion is between the punch and the ram, and the position adjustment mechanism drives the die positioning portion to adjust a position of the punch relative to the ram in the first direction, and the pressing machine further comprises a knockout pin that presses the movable die toward the ram, thereby discharging the workpiece from the punch receiving hole.

13. The pressing machine according to claim 12, wherein a plurality of the first press die portions and a plurality of the second press die portions are disposed side by side in pairs at equal intervals, the pressing machine further comprises a workpiece conveying device that sequentially moves the workpiece to an adjacent one of the pairs in synchronization with a motion of the ram, and the position adjustment mechanism is provided in one or more of the pairs.

14. The pressing machine according to claim 1, wherein a plurality of the first press die portions and a plurality of the second press die portions are disposed side by side in pairs at equal intervals, the pressing machine further comprises a workpiece conveying device that sequentially moves the workpiece to an adjacent one of the pairs in synchronization with a motion of the ram, and the position adjustment mechanism is provided in one or more of the pairs.

15. The pressing machine according to claim 1, wherein the position where the ram is away from the bottom dead center is within a prescribed range including before and after reaching a top dead center.

16. The pressing machine according to claim 1, wherein the second press die portion is a punch extending in the first direction, the first press die portion includes (i) a fixed die that has a punch receiving hole into and from which the punch advances and retracts and (ii) a movable die that linearly moves inside the punch receiving hole, a space being defined between the punch, the fixed die, and the movable die such that the workpiece is deformed into a cylindrical structure with one end closed, the die positioning portion positions the movable die at a bottom dead center that is at a position farthest from the ram in a movable range of the movable die, and the position adjustment mechanism drives the die positioning portion to adjust a position of the bottom dead center, and the pressing machine further comprises a knockout pin that presses the movable die toward the ram, thereby discharging the workpiece from the punch receiving hole.

17. A pressed product manufacturing method, comprising:

moving the ram of the pressing machine according to claim 1 in the up-and-down motion, thereby driving the second press die portion to deform the workpiece, during the continuous operation, receiving manual or automatic input to the controller of the position change data corresponding to a difference between (i) a manually or automatically obtained actual measurement value of a thickness of the deformed workpiece and (ii) a target value, and causing the controller to drive the servomotor during the continuous operation such that the position where the first press die portion or the second press die portion is positioned by the die positioning portion is changed to the position corresponding to the position change data when reaction force due to the press working is not applied to the die positioning portion.

18. A pressed product manufacturing method, comprising:

moving the ram of the pressing machine according to claim 2 in the up-and-down motion, thereby driving the second press die portion to deform the workpiece, during the continuous operation, receiving manual or automatic input to the controller of the position change data corresponding to a difference between (i) a manually or automatically obtained actual measurement value of a thickness of the deformed workpiece and (ii) a target value, and causing the controller to drive the servomotor during the continuous operation such that the position where the first press die portion or the second press die portion is positioned by the die positioning portion is changed to the position corresponding to the position change data when reaction force due to the press working is not applied to the die positioning portion.

19. A pressed product manufacturing method, comprising:

moving the ram of the pressing machine according to claim 6 in the up-and-down motion, thereby driving the second press die portion to deform the workpiece, during the continuous operation, receiving manual or automatic input to the controller of the position change data corresponding to a difference between (i) a manually or automatically obtained actual measurement value of a thickness of the deformed workpiece and (ii) a target value, and causing the controller to drive the servomotor during the continuous operation such that the position where the first press die portion or the second press die portion is positioned by the die positioning portion is changed to the position corresponding to the position change data when reaction force due to the press working is not applied to the die positioning portion.

20. A pressed product manufacturing method, comprising:

moving the ram of the pressing machine according to claim 7 in the up-and-down motion, thereby driving the second press die portion to deform the workpiece, during the continuous operation, receiving manual or automatic input to the controller of the position change data corresponding to a difference between (i) a manually or automatically obtained actual measurement value of a thickness of the deformed workpiece and (ii) a target value, and causing the controller to drive the servomotor during the continuous operation such that the position where the first press die portion or the second press die portion is positioned by the die positioning portion is changed to the position corresponding to the position change data when reaction force due to the press working is not applied to the die positioning portion.

21. A pressed product manufacturing method, comprising:

moving the ram of the pressing machine according to claim 12 in the up-and-down motion, thereby driving the second press die portion to deform the workpiece, during the continuous operation, receiving manual or automatic input to the controller of the position change data corresponding to a difference between (i) a manually or automatically obtained actual measurement value of a thickness of the deformed workpiece and (ii) a target value, and causing the controller to drive the servomotor during the continuous operation such that the position where the first press die portion or the second press die portion is positioned by the die positioning portion is changed to the position corresponding to the position change data when reaction force due to the press working is not applied to the die positioning portion.

22. A pressed product manufacturing method, comprising:

moving the ram of the pressing machine according to claim 14 in the up-and-down motion, thereby driving the second press die portion to deform the workpiece, during the continuous operation, receiving manual or automatic input to the controller of the position change data corresponding to a difference between (i) a manually or automatically obtained actual measurement value of a thickness of the deformed workpiece and (ii) a target value, and causing the controller to drive the servomotor during the continuous operation such that the position where the first press die portion or the second press die portion is positioned by the die positioning portion is changed to the position corresponding to the position change data when reaction force due to the press working is not applied to the die positioning portion.

* * * * *